US005545001A

United States Patent [19]

Capdeboscq

[11] Patent Number: 5,545,001

[45] Date of Patent: Aug. 13, 1996

[54] STATION FOR PILING, SEPARATING AND EJECTING BATCHES OF PLATE-LIKE WORKPIECES AT AN OUTLET OF A PROCESSING MACHINE

[75] Inventor: Bernard Capdeboscq, St. Just-Chaleyssin, France

[73] Assignee: SA Martin, Villeurbanne, France

[21] Appl. No.: 383,861

[22] Filed: Feb. 6, 1995

[30] Foreign Application Priority Data

Feb. 7, 1994 [FR] France ..... 94 01546

[51] Int. Cl.[6] ..... B65G 57/03

[52] U.S. Cl. ..... 414/790.8; 414/790.2; 414/794.8

[58] Field of Search ..... 414/790.2, 790.8, 414/794.8

[56] References Cited

U.S. PATENT DOCUMENTS

| | | | |
|---|---|---|---|
| 3,892,168 | 7/1975 | Grobman | 414/790.8 |
| 4,311,475 | 1/1982 | Imai . | |
| 4,359,218 | 11/1982 | Karis . | |
| 4,432,685 | 2/1984 | Stauber | 414/790.8 |
| 4,541,763 | 9/1985 | Chandhoke et al. | 414/790.2 |
| 4,765,790 | 8/1988 | Besemann | 414/790.8 |
| 4,799,847 | 1/1989 | Bodewein | 414/790.8 |
| 5,014,974 | 5/1991 | Jones et al. | 414/790.8 |
| 5,160,129 | 11/1992 | Siriporn et al. . | |

FOREIGN PATENT DOCUMENTS

| | | |
|---|---|---|
| 1113516 | 12/1981 | Canada . |
| 529708 | 3/1993 | European Pat. Off. . |
| 2348882 | 11/1977 | France . |
| 2445563 | 7/1980 | France . |
| 2511352 | 2/1983 | France . |

*Primary Examiner*—Karen B. Merritt
*Assistant Examiner*—Douglas Hess
*Attorney, Agent, or Firm*—Hill, Steadman & Simpson

[57] ABSTRACT

A station for piling, separating and ejecting batches of workpieces includes rollers for carrying the workpieces against a front stop and placing them on a table movable in a descending fashion, separating arms connected to a horizontal separator-carrying crossbar and an outlet conveyor at a level of which the table descends for removing the batches. The station includes temporary front and rear holders for supporting the workpieces as the separator is withdrawn to move the batch from the table onto the outlet conveyor, which may have a driven portion so that a shifting force for transferring a batch from the table to the conveyor occurs both on the uppermost and lowermost workpiece of the batch or stack.

12 Claims, 4 Drawing Sheets

STATION FOR PILING, SEPARATING AND EJECTING BATCHES OF PLATE-LIKE WORKPIECES AT AN OUTLET OF A PROCESSING MACHINE

BACKGROUND OF THE INVENTION

The present invention is directed to a station for piling, separating and creating batches which consist of a predetermined number of piled plate-like workpieces, such as sheets of paper or cardboard or even flat-folded cardboard boxes. The station is located downstream a station for counting and carrying the workpieces coming out of a processing machine.

In the station for counting and carrying, the sheets are successively forwarded along a distribution conveyor in front of a counting device which includes, for instance, a photoelectric cell, and then to a piling station which comprises a collecting device, such as a hopper, in which the sheets are aligned into regular piles. A specific form of mechanism is required in order to adapt the growing pile to the collector. A known mechanism enables the conveyor to be raised in close connection with the growing pile, whereas the most standard so-called freely dropping mechanism forces the sheets to land on a table with alternate vertical movement, which table descends at a speed of the growing pile. Once the number of sheets which make up a batch is reached, a problem of proper ejection of the batch or pile and removal of this batch without stopping the machine will occur.

This type of piling station is described in French Patent No. 2,348,882 and comprises a plurality of parallel L-shaped fingers which make up a separator, normally arranged horizontally and rotatably at one of its ends on a movable carriage. The separator is for temporarily receiving sheets dropping onto the top of the previous batch which is in the process of being removed by a conveyor. The station comprises, moreover, a second plurality of parallel T-shaped fingers connected by a shaft, thus making up a table which can be moved vertically through the conveyor in order to carry the sheets temporarily piled on the separator and to deliver them onto the conveyor during the time in which the separator is withdrawn in order to take up an oblique position and gets back to its resting position on top of the pile being built up on the conveyor. When the next batch is built up, the separator again descends in order to collect the next sheet. However, the maximum number of sheets belonging to such a batch depends on the maximal raising angle of the separator, which is necessarily little with regard to the mechanical stresses that exist.

A station or device described in U.S. Pat. No. 4,311,475, whose disclosure is incorporated herein by reference thereto and which claims priority from the same Japanese Application as French Published Application 2,445,563, comprises a hopper closed at the bottom by a vertically movable table, on which table the aligned sheets will pile up. When a predetermined number of sheets is reached, a rear finger lands on the batch in order to separate the batch from the next sheets and the batch then descends together with the table until the table reaches a level for a removal or ejection conveyor. A pusher moves the batch laterally toward the removal conveyor, the upper sheets being held at a rear side or edge by the finger and at a forward edge by the batch for the time the pusher requires to shift the batch from the table onto the conveyor and then to retract. The table is then raised in order to receive the upper sheets. A second finger is movable vertically and parallel with the first finger, which is already in the resting position for separating the next batch.

However, the table has to have a surface lower than the surface of the sheets. Moreover, this station requires a complex device for shifting in phase opposition two separating fingers.

A station is described in U.S. Pat. No. 4,359,218, whose disclosure is incorporated herein by reference thereto and which was the basis for French Published Application 2,511,352. In this station, sheets are accumulated on a pile carried by a table movable downward inside a hopper. As soon as a predetermined number of sheets is reached, a plate or interrupter bar moves from the front of the hopper over a short distance on the top of the pile. The table which carries the pile continues to move downward with regard to the interrupter so that a space is created, within which supporting arms are then inserted. The interrupter can then be retracted, and the arms will carry the accumulation of the next sheets. The batch is then lowered by the movable table onto an ejecting belt carrier or conveyor. The empty table then is raised and lifts the new pile by passing between the supporting arms. These arms are then retracted and are ready for a new cycle. However, the control mechanism for the interruption plate is rather complex in coordination with the movement of the supporting arms.

U.S. Pat. No. 5,160,129, whose disclosure is incorporated herein by reference thereto and which was the basis for European Published Application 0 529 708, describes a piling station specifically foreseen for flat-folded cardboard boxes at the end of a folding and gluing process, but whose certain flaps may be turned up. In this station, the sheets carried by the upstream distributing conveyor are sent into a hopper against a front stop by two ejecting or firing rollers, which are horizontal and parallel in a rear vertical plane. The sheets drop aligned on top of the pile that is growing on a hoisting table which descends as the pile grows.

When a batch is built up, a separator, which is situated at the front of the hopper and which consists of a plurality of forks connected by a crossbar movable along a first vertical toothed rack and a second horizontal toothed rack comes to lay on top of the batch in order to collect the next sheets. The table then descends until it reaches a level of the removing conveyor on which the batch is transferred by a pusher. The empty table then raises to take care of the new pile which is being accumulated on the separator and which has descended, as required. The separator is retracted in a forward translation and then raises toward its resting position at a level of the ejecting rollers.

During the descent of the table, a set of secondary forks, which have initially been integrated in the first set, descend owing to gravitational force in order to maintain a light pressure on the top of the batch prior to the batch being ejected. Moreover, above the ejecting carrier, a second pressing carrier or conveyor is permanently installed, which carrier is to apply a light holding pressure on the batch being ejected or removed. However, these applied pressures are low and become quickly inefficient as soon as movement with quicker acceleration is required.

The front stops are arranged together on a horizontal spindle which allows for adjusting their position according to the size of the boxes to be received. However, it is quickly evident that the device for driving the separator along the toothed rack can only be of a low force, which fact leaves the separator only a passive role of accompanist. The station then necessitates the use of a stronger pusher in order to eject the batch of boxes, which always consists of a slow, heavy and expensive member or element for the station.

Moreover, numerous flexible cams are arranged rotatably on an axle located at the level of the ejecting rollers. These cams regularly engage or hit the rear edge of each box in order to push it forward onto the pile. However, this device, as well as its coordination means, are very complicated for the little effect obtained.

Above all, all of the above-mentioned stations can only function at satisfaction with limited speed, due to the inertia of the complex mechanism used, the retractable fingers and pushers.

SUMMARY OF THE INVENTION

An object of the present invention is to provide a station for piling, separating and ejecting batches of piled plate-like workpieces of the "free dropping" type, as those described above, but which ensures a better quality reliability of the ejected batches owing to the optimization, if not a simplification, of the constituent elements.

These goals are reached in an improvement in a station for piling, separating and ejecting batches of piled plate-like workpieces, the station being located at the outlet of a machine processing such workpieces and comprising a frame, means for carrying plate-like workpieces against a front stop with the workpieces dropping on the top of a pile growing on a hoisting table which descends as the pile grows, the top of the table having means for conveying consisting of a track of rollers or endless belts, separating means having separator arms connected to a horizontal separator-carrying crossbar movable in translation parallel and perpendicular to the plane of the table, said separator arms reaching their position from the front on top of the batch in order to receive the plate-like workpieces which follow as soon as the batch includes the predetermined number of plate-like workpieces is to be removed, and an outlet conveyor means for removal of the batch being positioned at the level of which the table descends. The improvements comprise the station including temporary front and rear holders for the plate-like workpieces, said holders being arranged to extend almost parallel to the plane of the surface of the table and located at the level of the lower edge of the front stop, the front and rear holders in combination with means for driving the separator-carrying crossbar, which include at both lateral ends of the crossbar a chain or drive belt passing at right angles downstream the station and behind the front stops by means of an upper idler pulley and a lower idler pulley and upstream the station by means of a return wheel, at least one of the two lateral wheels being driven, and in combination with means for guiding the separator-carrying crossbars in order to maintain the separator arms permanently parallel to the plane of the table.

In other words, owing to the reinforcement of the driving means of the separators and to the addition of the two temporary insertable front and rear holders, each being simply moved by an actuator, it is possible to use these separator arms also as traction means owing to the rubbing on the top of the batch during the removal of the batch, and this as a replacement for the pusher which is always too slow. Thus, a simultaneous vertical holding force and a horizontal withdrawing force on the batch which rests on the free rollers of the conveyor of the table, which action generates a withdrawal movement which is reliable even if very quick.

Should the means for conveying of the table be driven or motorized or, alternatively, the track of rollers or the endless belts making up the means for conveying of the table be free but the table be susceptible of being integrated in a motorized removal conveyor located at the beginning of the outlet conveyor, then, by coordination of the upper and lower driving means, a particularly strong and balanced force for withdrawing a batch is obtained which allows a noticeable acceleration and, hence, a speed not previously obtained.

As an advantageous feature, the guiding means of the separator-carrying crossbar includes at least a first carrier being part of the crossbar and slidable along a first shifting axle which is either parallel or perpendicular to the table plane, this first axle being part of a second carriage slidable along a second shifting axle which is perpendicular to the first axle. By dimensioning appropriately this arrangement, and, particularly, by adding ball tracks in the carriage so as to diminish the sliding forces, strong guiding means are obtained which simultaneously have a low inertia.

As an advantageous feature, the hoisting table, as well as the separators and the outlet conveyor, are slanted rearward with the angle comprising between 5° and 15°, and preferably at 10° to the horizontal plane. In fact, owing to the strong means used for ejecting a batch, a rearward angle is allowed which enhances the alignment of the pile against the rear stop.

Advantageously, the temporary front holders include a plurality of parallel fingers, each being advanced or retracted directly by an actuator. In a similar way, the rear temporary or insertable holder includes a plate tiltable around a horizontal axle which has a lever arm connected to an actuator. Thus, the holders are cheap for realization but dynamic and able to undergo a high speed owing to the simplicity of their configuration and design.

In a useful way, the station includes, among other items, one or several pressers, hung rotatably onto a crosswise axle carried at each end by supports, this presser or pressers pushing onto the last incoming plate-like workpiece and resting on top of the pile. Such a device, which is of a rather simple conception, ensures a quick positioning of every workpiece on the pile where it is held in order to avoid any rebound or other parasitic movement.

In a preferred embodiment, the idler wheels or pulleys and the return wheel of the means for driving the separator-carrying crossbar are located on each side and are respectively arranged on two identical lengthwise plates and held parallel between them by crossbars to form a sub-frame. The position of the sub-frame formed by these plates being simultaneously changeable along the lengthwise beam of the frame of the station in order to easily take into consideration a change in the size of the sheets or boxes of every production series. Other advantages and features of the invention will be readily apparent from the following description of the preferred embodiments, the drawings and claims.

DESCRIPTION OF THE PREFERRED EMBODIMENTS

Figure 1:
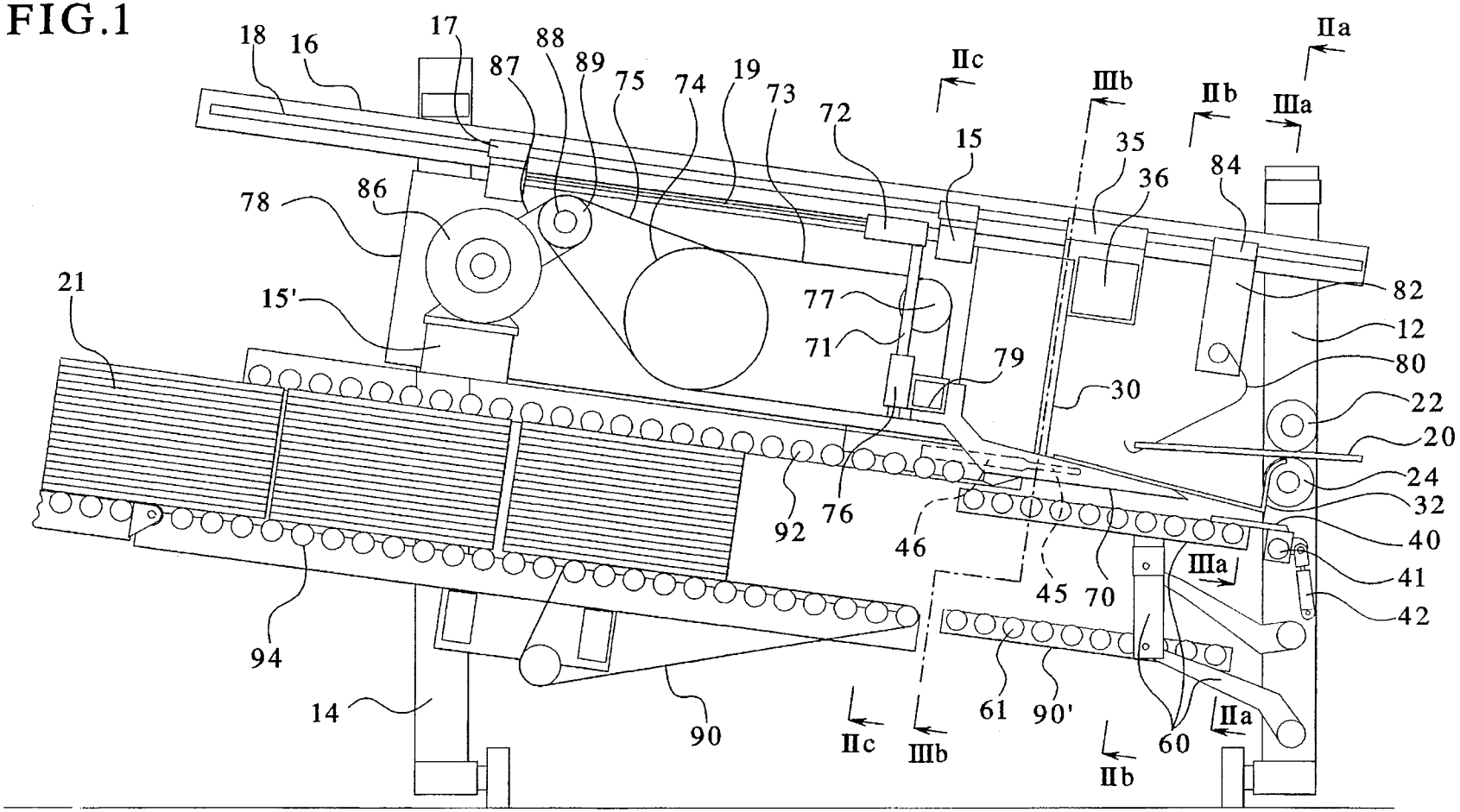
FIG. 1 is a lengthwise cross sectional schematic view of a station according to the present invention.

The principles of the present invention are particularly useful in a station shown in FIG. 1. The station has a frame made up of a pair of rear posts 12 connected to a pair of front posts 14 by upper lateral lengthwise beam 16.

A plate-like workpiece 20, which comes upstream from a counting and carrying station, which is not illustrated, will travel through a pair of ejection rollers 22, 24, which rollers are arranged to extend between the rear posts 12. These plate-like workpieces 20 will pile up on a table 60 in order to make up a batch or pile 21, which will then be ejected or moved downstream on an outlet conveyor 94. In other words, the rear posts 12 are located upstream with regard to the travelling direction of the workpieces being produced and on the right-hand side of FIG. 1, whereas the front posts 14 are located downstream, i.e., on the left-hand side of FIG. 1.

Figure 2A:
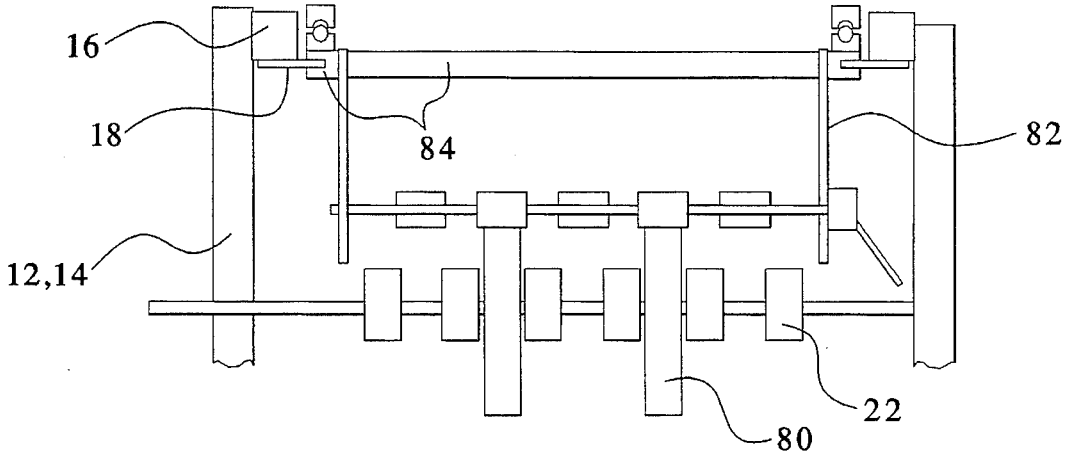
FIG. 2*a* is a cross sectional view taken along the line IIa of FIG. 1.
Figure 2B:
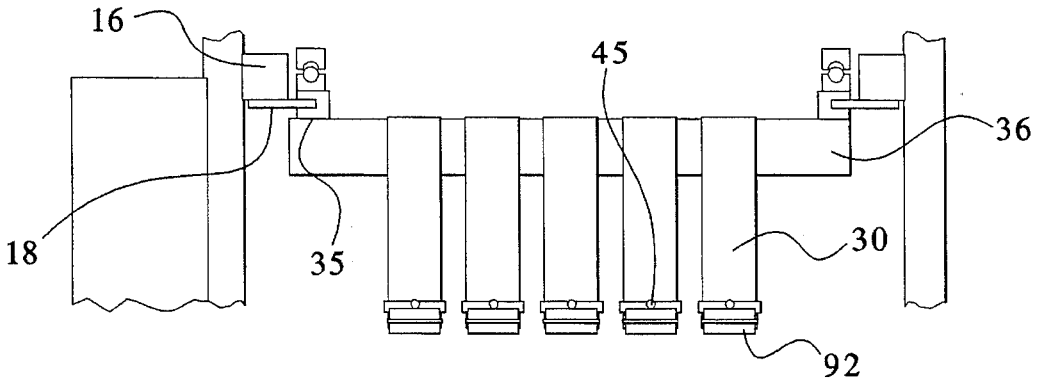
FIG. 2*b* is a cross sectional view taken along the line IIb of FIG. 1.

Front stops 30, which are also visible in FIG. 2*b*, are arranged opposite the ejecting rollers 22 and 24 and have the shape of plates which extend almost vertically and are mounted on the same girder or beam 36. This beam 36 is secured along the lengthwise beams 16 by means of a carriage 35, which slides on a rail 18 (see FIG. 2*b*) of the lengthwise beams 16, which system thus allows a setting in depth of the position of these stops according to the length of the plate-shaped workpieces 20.

The workpieces 20 are simultaneously pushed downward by pushers 80 which are hung to rotate on a horizontal axle carried along by a support 82, which is best illustrated in FIG. 2*a*. As before, the supports 82 are connected onto the lengthwise beams 16 by means of a carriage 84 which slides on the rails 18 and which system allows also an adjustment in depth of their position relative to the rollers 20 and 24.

Figure 3A:
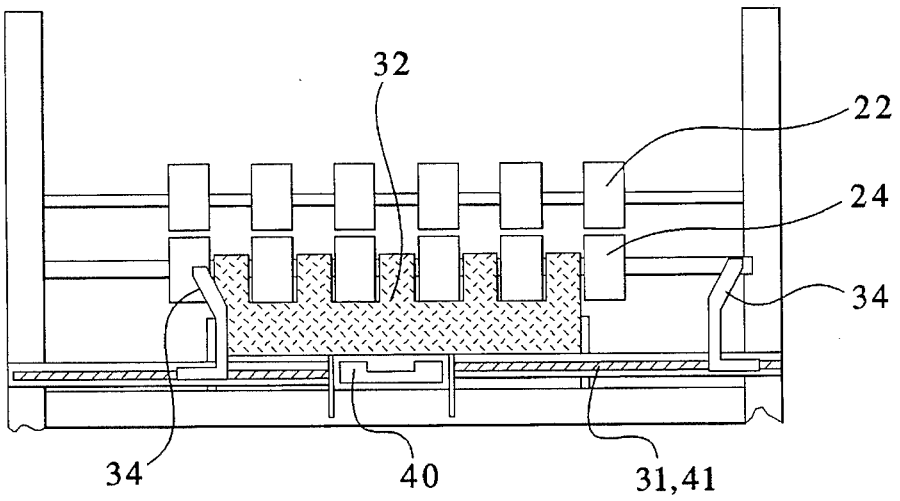
FIG. 3*a* is a cross sectional view taken along the line IIIa of FIG. 1.

When dropping, the workpieces 20 are aligned at the front by the stops 30 and on the rear by a stop 32 and on the sides by lateral stops 34, which are illustrated in FIG. 3*a*. In fact, the lateral position of the stops 34 may be set by actuating setting or adjustment screws 31. The workpieces 20, thus, accumulate in a very regular pile on the table 60. The table 60 descends as the pile grows in such a way that the height at which the next workpieces are dropped remain almost constant.

Figure 2C:
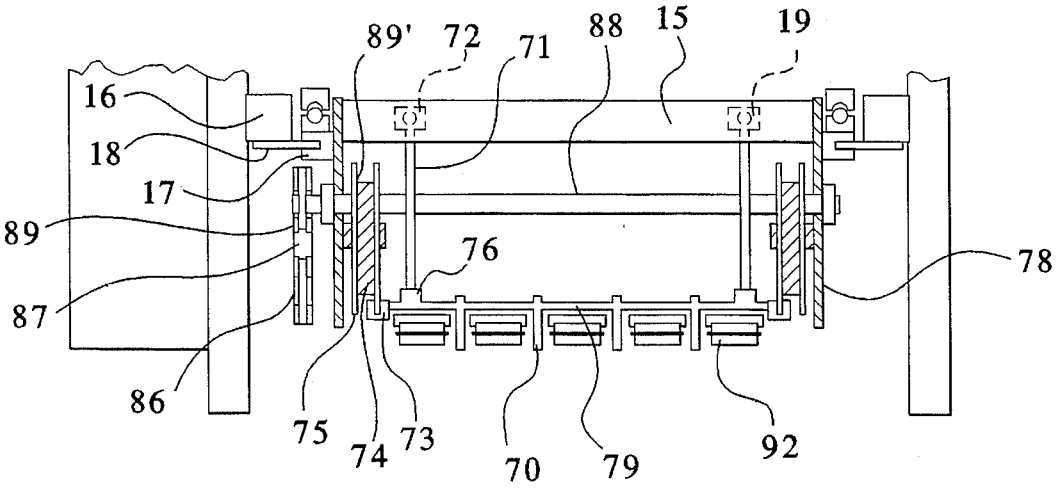
FIG. 2*c* is a cross sectional view taken along the line IIc of FIG. 1.

As may be seen in FIGS. 1 and 2*c*, the station includes a device for separating the batches 21 of workpieces piled with a predetermined number, which device has the form of a plurality of separator arms 70 connected at the front end to the same horizontal separator-carrying crossbar 79. These separator arms 70 have the shape of a flattened bar or plate in the vertical direction, which has, in the horizontal section, a slightly tapering form directed rearward to end as a point facing the rear stop 32. More specifically, according to the present invention, the separator-carrying crossbar 79 is supported on both ends by a chain or belt 73, which defines its travelling track. Moreover, the crossbar 79 supports one or several carriages 76, which may slide along a first shifting axle 71 which extends almost vertically and perpendicular to the plane of the table 60, and this axle itself is part of a horizontal carriage 72 which may also slide along a second shifting axle 19, which is almost horizontal. Thus guided, the separator arms 70 remain constantly parallel to the plane of the table 60.

As seen in FIG. 1, the chain 73 makes the separating elements effect a vertical translation behind the stops 30, then a lower forward translation followed by an upward return around a return wheel 74 which ends with an upper rearward translation before reaching a resting position at a level of an upper idler wheel 77. As better visualized in FIG. 2*c*, the upper and lower idler wheels or pulleys 77, as well as the return wheel 74, are mounted on either side of the station on a lengthwise plate 78. These two lateral plates 78 are connected to one another by means of several crossbars 15 and 15' to form a sub-frame. The plates of the sub-frame are themselves connected to the lengthwise beams 16 through carriages 17 slidable along the same rail 18 in order to allow the adjustment in depth of the position of the separators according to the size of the plate-like workpieces. Parallely and horizontally shifting axles 19 of the carriage 72 are held between the two upper crossbars 15.

The output pulley of a motor 86, which is mounted between the plates 78, is connected by means of a driving chain or belt 87 to an outer pulley 89 which is part of a transmission shaft 88 carrying a driving pulley 89' (FIG. 2*c*) for each of the return wheels 74. It is also possible to drive these return wheels 74 by means of a driving chain or belt 75. The drive of the separators 70 is, hence, both strong and balanced on either side.

Moreover, the hoisting table 60 is able to descend onto the level of an outlet conveyor 94 for the built up batches or piles 21. The outlet conveyor 94 starts upstream with a motorized ejection conveyor 90 which will be aligned with the carrier 60 when it is moved to its lower positions 90' (FIG. 1). The hoisting table 60 may have a conveyor formed of a plurality of roller tracks or by a belt arrangement and this conveyor may be driven.

Figure 3B:
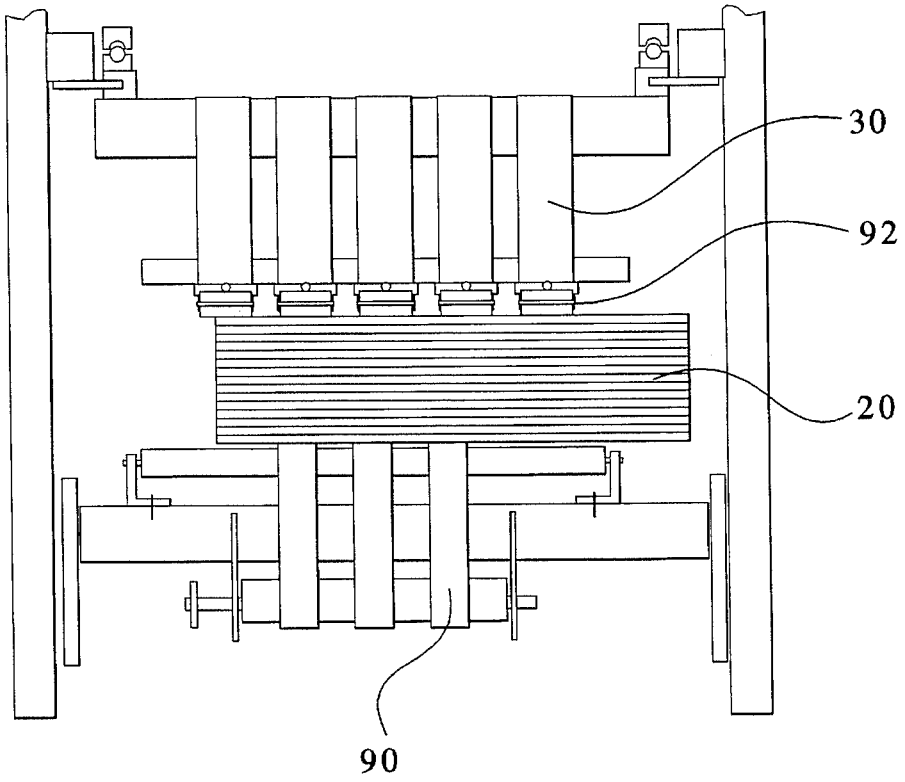
FIG. 3*b* is a cross sectional view taken along the line IIIb of FIG. 1.

An upper roller ramp 92 is arranged above the outlet conveyor 94 and applies a pressure on the top of the batches 21. This ramp 92 is connected at its rear end to the lower part of the front stops 30, as illustrated in FIG. 3*b*, and at its front end to a frame crossbar which may be better seen in FIG. 1.

Moreover, the station includes a plurality of temporary holders 45 having the shape of fingers, each being forwardly or rearwardly directed by an actuator 46 arranged in their front extension. A temporary rear holder 40 is arranged on the rear posts 12 opposite and within the same plane parallel to the table 60. As may be better seen in FIG. 3*a*, this temporary holder 40 has the shape of a plate rotatable with an axle 41 in such a way as to be tiltable forward by means of an actuator 42, represented in FIG. 1, and connected to a rear leg or lever of the axle 41.

The operation of the above-mentioned station will now be explained with reference to FIGS. 4*a*–4*f*.

Figure 4A:
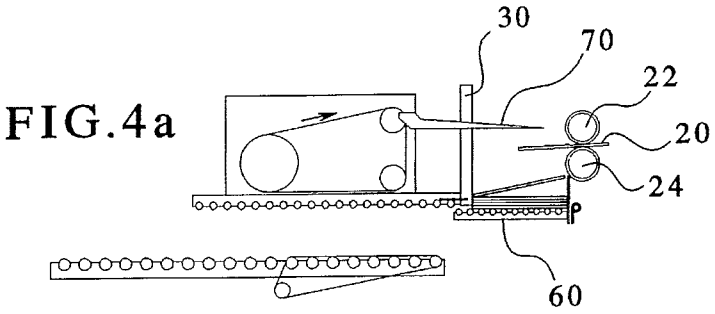
FIGS. 4*a*–4*f* are schematic illustrations of six successive phases of the station cycle.

As illustrated in FIG. 4*a*, the station is in the position when piling of a first batch starts up. The separator arms 70 are then in a high resting position, whereas the plate-like workpieces 20 ejected by the rollers 22 and 24 against the front stop 30 drop on the pile which grows on the table 60 which is initially in its upper position.

Figure 4B:
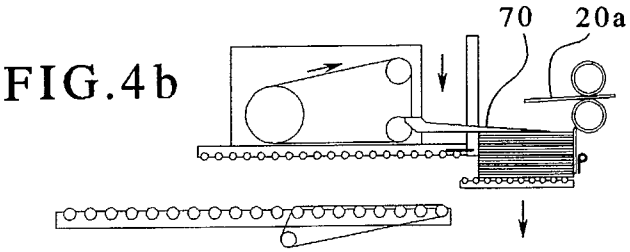

FIG. 4*b* represents the movement when the separator arms 70 are moved down onto the top of the pile at the instant when a batch is counted, and this is in order to receive the next plate-like workpieces 20*a* on the arms 70. The separator arms 70 and the table 60 then move down simultaneously and the separator arm applies a pressure on the batch built up on the table.

Figure 4C:
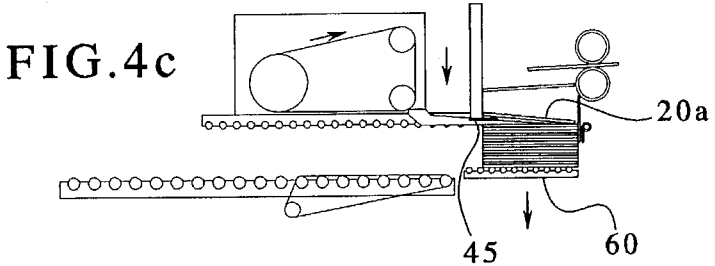

As illustrated in FIG. 4*c*, the separator arms 70 have reached their lower position on the front stop 30, i.e., at the level of the temporary front holder 45 when the table 60 is at the level of the motorized ejecting or removal conveyor 90. Owing to the tapered form given to the horizontal sections of the separator arms 70, a space is open between the batch and the next plate-like workpiece 20*a*, in which space the front holders 45 may protrude without any effort.

Figure 4D:
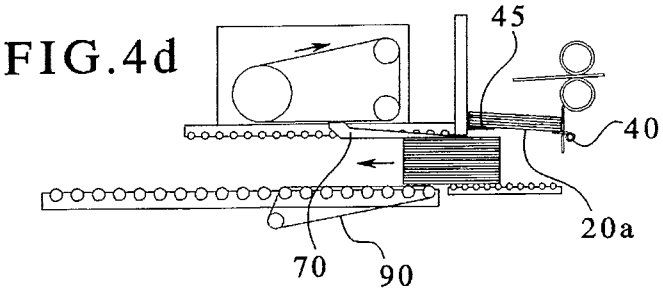

As illustrated in FIG. 4*d*, a major effect of the invention is that the batch can be pulled by the separator arms 70 acting horizontally on the top of the batch owing to the friction forces resulting from the vertical pressure applied thereto. In a preferred embodiment, the motorized conveyor 90 enters simultaneously into action, which operation allows therewith a particularly quick and balanced removal. From the beginning of the move of the batch and at the same time as it still holds the upper sheets, the temporary holder 40 is tilted into a horizontal position, and the upper workpieces 20*a* are then fully isolated from the batch.

Figure 4E:
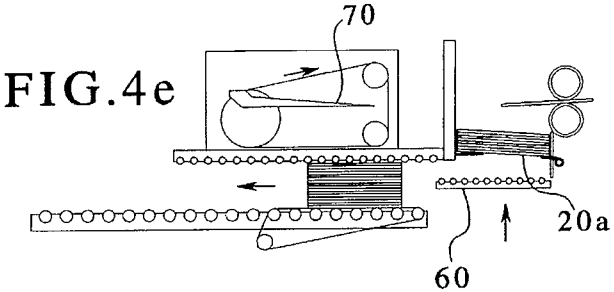

As illustrated in FIG. 4*e*, during the removal of the batch, the empty table then moves immediately upward again toward the new batch being built up of the workpieces 20*a*, whereas the separator arms 70 move from the bottom to the top around the return wheel and then effectuates the upper translation to the upper resting position.

Figure 4F:
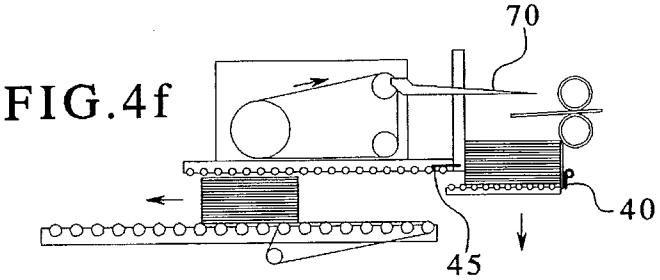

As shown in FIG. 4*f*, the front holder 45 and the rear holders 40 may have been retracted as soon as the table 60 has supported the new pile and the table starts its descent again in accordance with the progression of the accumulation. It should be noted that the table 60 is provided with slots or grooves to enable the rear holder 40 to pivot from the holding position of FIG. 4*e* to the retracted position of FIG. 4*f*. In the meantime, the separator arms, as illustrated in FIG. 4*f*, have reached their upper resting position ready to come down as soon as the next batch is completed.

As may have been gathered from the reading of this description, the batch, once built up, is systematically held tight on top and underneath by means of the elements in the course of its removal, which can be effectuated very quickly, even if this movement includes a high degree of acceleration.

Owing to the power of the elements implicated in the removal of the batches, it is allowed an orientation of the station slightly slanted rearwardly, as shown in FIG. 1, which design improves, particularly, the alignment of the piles. Numerous improvements can be added to this station within the limits of the claims.

Although various minor modifications may be suggested by those versed in the art, it should be understood that I wish to embody within the scope of the patent granted hereon all such modifications as reasonably and properly come within the scope of my contribution to the art.

I claim:

1. A station for piling, separating and ejecting batches of workpieces which have a shape of a plate and are piled at an outlet of a machine that processes said workpieces, said station including a main frame containing means for carrying the workpieces against a front stop, with the workpieces dropping on top of a pile growing on a hoisting table which descends as the pile grows, said table having a top surface with means for conveying, separating means having separator arms connected to a horizontal separator-carrying crossbar movable in translation parallel and perpendicular to a plane of the top surface of the table, said separator arms reaching a position from a front side of the pile and on top of a batch of workpieces in the pile in order to receive the next workpiece as soon as the batch includes a predetermined number of the workpieces, an outlet conveyor means for removing of the batch being positioned at a level to which the table descends, the station including temporary front and rear holders for the workpieces, said holders being arranged to extend almost parallel to the plane of the top surface of the table and located at a level of a lower edge of the front stop, means for driving the separator-carrying crossbar including at both lateral ends of the crossbar a drive extending downstream of the station behind the front stop with the separator-carrying crossbar moving in a continuous circular path and said path being defined by a return wheel and at least two idler wheels, said station including means for guiding the separator-carrying crossbar in order to maintain the separator arms permanently parallel to the plane of the table.

2. A station according to claim 1, wherein the means for conveying of the table is a positively driven conveyor.

3. A station according to claim 2, wherein the positively driven conveyor comprises rollers.

4. A station according to claim 2, wherein the positively driven conveyor includes driven endless belts.

5. A station according to claim 1, wherein the outlet conveyor means has a positively driven section located adjacent a lowermost portion of the table and aligned therewith.

6. A station according to claim 1, wherein the guiding means for the separator-carrying crossbar includes at least a first carriage being mounted on the crossbar and movable along a first shifting axle which extends substantially perpendicular to the plane of the table, said first axle being mounted on a second carriage movable along a second shifting axle which is perpendicular to the first axle and substantially parallel to said table plane.

7. A station according to claim 1, wherein the table, and the separator arms are slanted rearwardly with an angle in a range of 5° to 15° to a horizontal plane.

8. A station according to claim 7, wherein said angle is 10°.

9. A station according to claim 1, wherein the front holders include a plurality of parallel fingers, each finger being moved from an advanced to a retracted position by an actuator.

10. A station according to claim 1, wherein the rear holder includes a plate secured to a rotational axle, said axle being rotated by an actuator.

11. A station according to claim 1, which includes a plurality of pressing elements being mounted for rotation on a crosswise axle, said axle being mounted on said frame with the pressing elements pushing onto the workpiece entering the station and resting on top of the last workpiece of each pile.

12. A station according to claim 1, wherein each of the idler wheels and the return wheel of the means for driving the separator-carrying crossbar are located on the same side and are respectively arranged on two identical lengthwise plates held parallel to each other by crossbars to form a sub-frame, said sub-frame being mounted for movement within the main frame in a lengthwise direction.

* * * * *